US007111613B1

(12) United States Patent
Barnes et al.

(10) Patent No.: US 7,111,613 B1
(45) Date of Patent: Sep. 26, 2006

(54) FUEL INJECTOR CONTROL SYSTEM AND METHOD

(75) Inventors: Travis E. Barnes, Metamora, IL (US); Stephen R. Lewis, Chillicothe, IL (US); Dana R. Coldren, Fairbury, IL (US); Rammohan Sankar, Peoria, IL (US); Daniel Yongxiang Li, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/139,653

(22) Filed: May 31, 2005

(51) Int. Cl.
*F02M 47/02* (2006.01)
*F02M 59/46* (2006.01)

(52) U.S. Cl. ..... 123/467; 239/88; 239/533.8

(58) Field of Classification Search ..... 123/446, 123/458, 467, 501, 503, 505, 514; 239/88, 239/90, 91, 95, 533.3, 124, 533.8, 127, 533.9, 239/585.1–585.5; 251/129.15, 129.16, 129.21; 701/102, 103, 104, 105; 335/265, 281
See application file for complete search history.

(56) References Cited

U.S. PATENT DOCUMENTS 5,713,520 A * 2/1998 Glassey et al. ..... 239/124
5,893,516 A 4/1999 Harcombe et al.
5,915,623 A 6/1999 Knight et al.
5,915,624 A 6/1999 Coldren et al.
5,934,559 A 8/1999 Coldren et al.
5,939,963 A 8/1999 Harcombe
5,947,380 A 9/1999 Coldren et al.
5,971,300 A 10/1999 Coldren et al.
5,975,437 A 11/1999 Streicher et al.
5,979,415 A * 11/1999 Sparks et al. ..... 123/446
5,984,208 A 11/1999 Martin et al.
5,986,871 A 11/1999 Forck et al.
6,000,638 A 12/1999 Martin
6,167,869 B1 1/2001 Martin et al.
6,457,457 B1 10/2002 Harcombe
6,561,164 B1 5/2003 Mollin
6,640,787 B1 * 11/2003 Hashimoto et al. ..... 123/514
6,694,952 B1 * 2/2004 Yamazaki et al. ..... 123/506
6,725,147 B1 4/2004 Mollin
6,856,222 B1 2/2005 Forck
6,877,489 B1 * 4/2005 Hashimoto et al. ..... 123/514
2004/0163626 A1 8/2004 Stockner et al.

* cited by examiner

*Primary Examiner*—Willis R. Wolfe, Jr.
(74) *Attorney, Agent, or Firm*—Finnegan,Henderson,Farabow,Garrett&Dunner

(57) ABSTRACT

A fuel injector for an internal combustion engine having a crankshaft is disclosed. The fuel injector has plunger to displace fuel and an electronically controlled spill valve. The fuel injector also has a nozzle member having at least one orifice and a valve needle disposed within the nozzle member, and movable against a spring bias to selectively inject pressurized fuel through the at least one orifice. The fuel injector also has an electronically controlled check valve. The valve needle is automatically moved to inject pressurized fuel when the pressure of the fuel within the fuel injector reaches a predetermined valve opening pressure determined by a spring bias. Valve elements of the electronically controlled spill and check valves are both in a flow blocking position before the pressure of the fuel within the fuel injector reaches the predetermined valve opening pressure. Injection terminates when the valve element of the electronically controlled check valve is moved to a flow-passing position.

20 Claims, 4 Drawing Sheets

FUEL INJECTOR CONTROL SYSTEM AND METHOD

TECHNICAL FIELD

The present disclosure is directed to a control system and method and, more particularly, to a system and method for controlling operation of a fuel injector.

BACKGROUND

Fuel injected engines use injectors to introduce fuel into the combustion chambers of the engine. The injectors may be hydraulically or mechanically actuated with mechanical, hydraulic, or electrical control of fuel delivery. For example, a mechanically-actuated, electronically-controlled fuel injector includes a plunger movable by a cam-driven rocker arm to pressurize fuel within a bore of the injector. One or more electronic devices disposed within the injector are then actuated to deliver the pressurized fuel into the combustion chambers of the engine at one or more predetermined conditions.

One example of a mechanically-actuated, electronically-controlled fuel injector is described in U.S. Pat. No. 6,856,222 (the '222 patent) issued to Forck on Feb. 15, 2005. The '222 patent describes a fuel injector having a spring-biased, solenoid-controlled spill valve and a spring-biased, solenoid-controlled injection control valve. Both the spill valve and the injection control valve are associated with a cam-driven plunger and a control chamber of a valve needle. As the plunger is initially forced by a cam into a bore within the fuel injector, fuel within the bore flows past the spill valve to a low pressure drain. When the spill valve is electrically closed during further movement of the plunger into the bore, pressure within the bore builds. When an injection of fuel is desired, the injection control valve is electronically moved to connect the control chamber to the low pressure drain, thus permitting movement of the valve needle away from a seating to commence injection. To end injection, the injection control valve disconnects the control chamber from the low pressure drain to return the valve needle to its seating.

Although the injector of the '222 patent may sufficiently inject fuel into the combustion chambers of an engine, it may be limited when injecting small quantities of fuel. In particular, because both start of injection and end of injection are controlled with the same injection control valve, the valve element of the injection control valve may not have reached a point of stability after initiating start of injection when it must again move to end the injection. This lack of stability may create unpredictable and unrepeatable injection characteristics that could cause improper, unpredictable, unstable, and/or undesired operation of the engine.

The control method of the present disclosure solves one or more of the problems set forth above.

SUMMARY OF THE INVENTION

One aspect of the present disclosure is directed to a fuel injector for an internal combustion engine. The fuel injector includes a cam-driven plunger reciprocatingly disposed within a bore of the fuel injector to displace fuel from the bore, and an electronically controlled spill valve. The electronically controlled spill valve is associated with the bore and has a valve element movable between a first position at which the displaced fuel is allowed to drain from the fuel injector, and a second position at which the displaced fuel is retained within the fuel injector and increases in pressure in response to the displacement. The fuel injector also includes a nozzle member with at least one orifice, and a valve needle disposed within the nozzle member. The valve needle has a base end and a tip end, and is movable against a spring bias to selectively inject the pressurized fuel through the at least one orifice into the internal combustion engine. The fuel injector further includes an electronically controlled check valve in fluid communication with the bore and the base end of the valve needle. The electronically controlled check valve has a valve element movable between a first position at which the bore is fluidly communicated with the base end of the valve needle, and a second position at which the base end of the valve needle is fluidly communicated with a drain. The valve needle is automatically moved to inject the pressurized fuel when the pressure of the fuel within the fuel injector reaches a predetermined valve opening pressure determined by a spring bias. The valve elements of the electronically controlled spill and check valves are both in the second position before the pressure of the fuel within the fuel injector reaches the predetermined valve opening pressure. The injection terminates when the valve element of the electronically controlled check valve is moved to the first position.

Another aspect of the present disclosure is directed to a method of operating a fuel injector for an internal combustion engine. The method includes cammingly driving a plunger into a bore to displace fuel from the bore and electronically moving a valve element of a spill valve from a first position at which the displaced fuel is allowed to drain from the fuel injector to a second position at which the displaced fuel is retained within the fuel injector to increase the pressure of the fuel within the fuel injector. The method also includes electronically moving a check valve from a first position at which the pressurized fluid is communicated with the base end of the valve needle to a second position at which the base end of the valve needle is fluidly communicated with a drain. The method further includes automatically moving a valve needle against a spring bias to selectively inject the pressurized fuel into the internal combustion engine when the fuel pressure within the fuel injector reaches a predetermined valve opening pressure. The method additionally includes terminating the injection by returning the valve element of the electronically controlled check valve to the first position. The valve elements of the electronically controlled spill and check valves are both moved to the second position before the pressure of the fuel within the fuel injector reaches the predetermined valve opening pressure.

DETAILED DESCRIPTION

Figure 1:
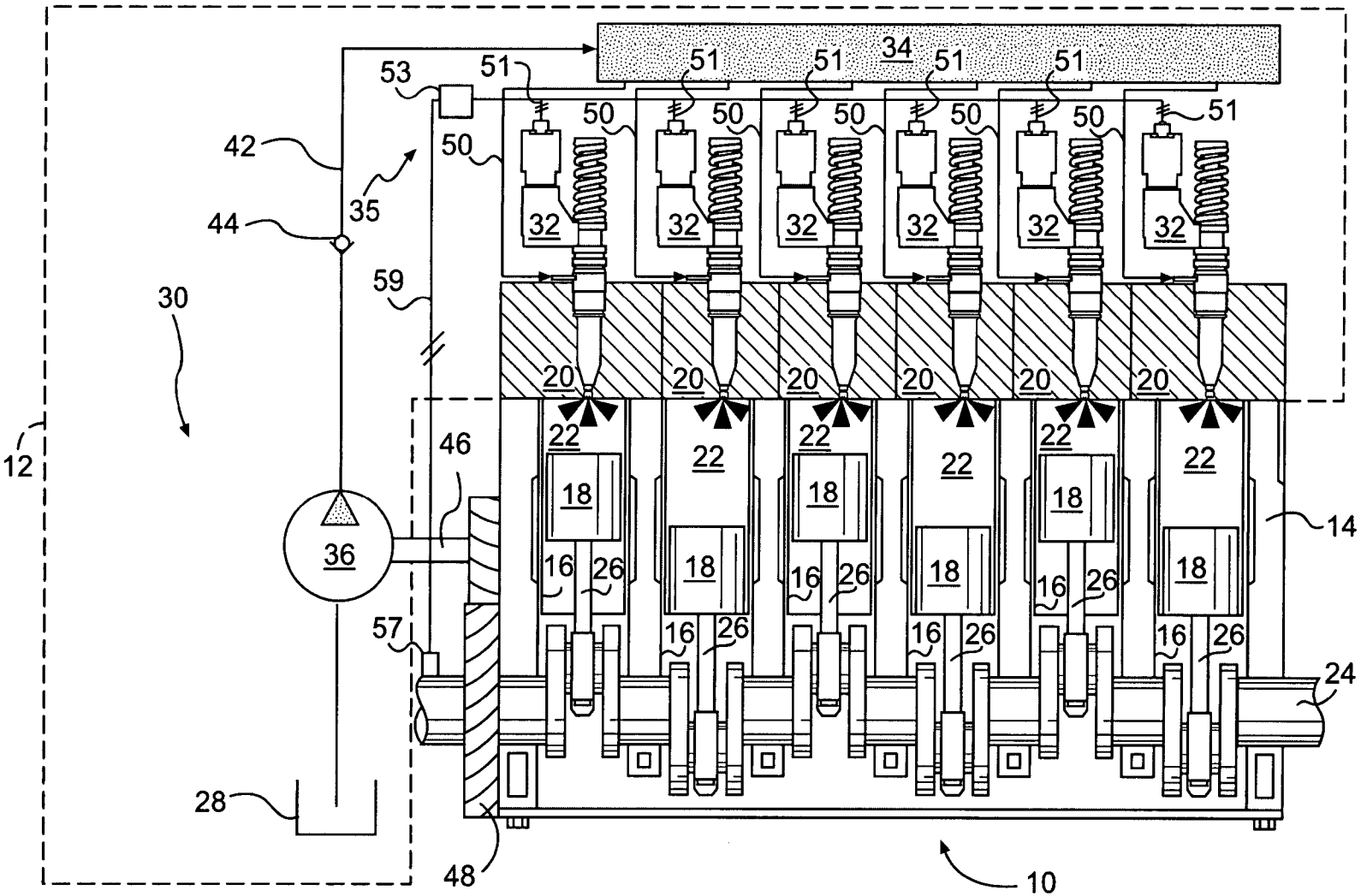
FIG. 1 is a schematic and diagrammatic illustration of an exemplary disclosed fuel system.

FIG. 1 illustrates an engine 10 and an exemplary embodiment of a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, a fuel pumping arrangement 30 configured to pressurize the fuel and direct the pressurized fuel to a plurality of fuel injectors 32 by way of a manifold 34, and a control system 35.

Fuel pumping arrangement 30 may include one or more pumping devices that function to increase the pressure of the fuel and direct one or more pressurized streams of fuel to manifold 34. In one example, fuel pumping arrangement 30 includes a low pressure source 36. Low pressure source 36 may embody a transfer pump configured to provide low pressure feed to manifold 34 via a fuel line 42. A check valve 44 may be disposed within fuel line 42 to provide for one-directional flow of fuel from fuel pumping arrangement 30 to manifold 34. It is contemplated that fuel pumping arrangement 30 may include additional and/or different components than those listed above such as, for example, a high pressure source disposed in series with low pressure source 36.

Low pressure source 36 may be operably connected to engine 10 and driven by crankshaft 24. Low pressure source 36 may be connected with crankshaft 24 in any manner readily apparent to one skilled in the art where a rotation of crankshaft 24 will result in a corresponding rotation of a pump drive shaft. For example, a pump driveshaft 46 of low pressure source 36 is shown in FIG. 1 as being connected to crankshaft 24 through a gear train 48. It is contemplated, however, that low pressure source 36 may alternatively be driven electrically, hydraulically, pneumatically, or in any other appropriate manner.

Fuel injectors 32 may be disposed within cylinder heads 20 and connected to manifold 34 by way of a plurality of fuel lines 50. Each fuel injector 32 may be operable to inject an amount of pressurized fuel into an associated combustion chamber 22 at predetermined timings, fuel pressures, and quantities. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration. In order to accomplish these specific injection events, engine 10 may request an injection of fuel from control system 35 at a specific start of injection (SOI) timing, a specific end of injection (EOI) pressure, and/or a specific quantity of injected fuel.

Control system 35 may control operation of each fuel injector 32 in response to one or more inputs. In particular, control system 35 may include a controller 53 that communicates with fuel injectors 32 by way of a plurality of communication lines 51, and with a sensor 57 by way of a communication line 59. Controller 53 may be configured to control a fuel injection timing, pressure, and amount by applying a determined current waveform or sequence of determined current waveforms to each fuel injector 32 based on input from sensor 57.

The timing of the applied current wave form or sequence of waveforms may be facilitated by monitoring an angular position of crankshaft 24 via sensor 57. In particular, sensor 57 may embody a magnetic pickup type sensor configured to sense an angular position, velocity, and/or acceleration of crankshaft 24. From the sensed angular information of crankshaft 24 and known geometric relationships, controller 53 may be able to calculate the position of one or more components of fuel injector 32 that are operably driven by crankshaft 24 and thereby control the injection timing, pressure, and quantity as a function of the calculated position.

Controller 53 may embody a single microprocessor or multiple microprocessors that include a means for controlling an operation of fuel injector 32. Numerous commercially available microprocessors can be configured to perform the functions of controller 53. It should be appreciated that controller 53 could readily embody a general work machine or engine microprocessor capable of controlling numerous work machine or engine functions. Controller 53 may include all the components required to run an application such as, for example, a memory, a secondary storage device, and a processor, such as a central processing unit or any other means known in the art for controlling fuel injectors 32. Various other known circuits may be associated with controller 53, including power supply circuitry, signal-conditioning circuitry, solenoid driver circuitry, communication circuitry, and other appropriate circuitry.

Figure 2:
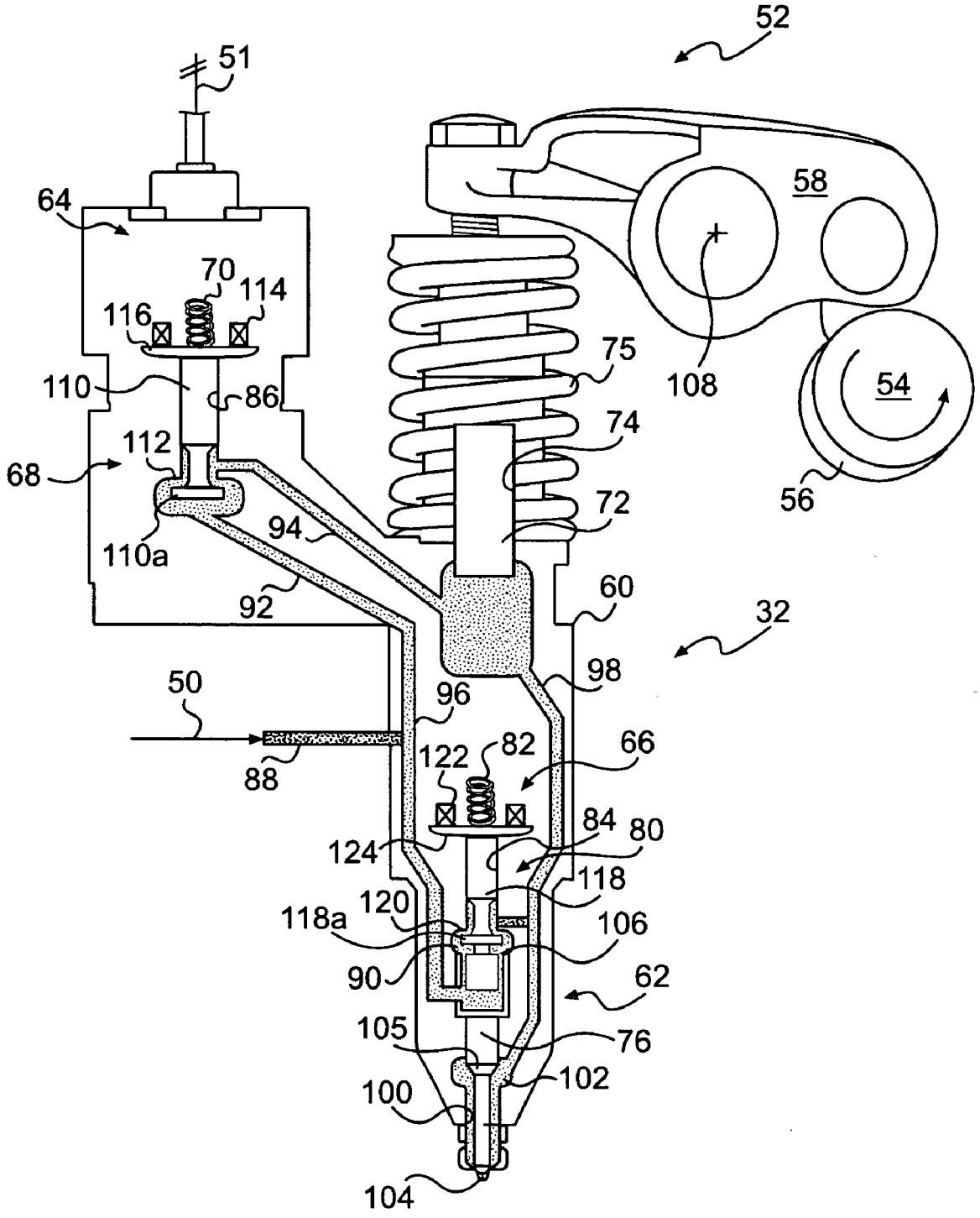
FIG. 2 is a cutaway view illustration of an exemplary disclosed fuel injector for the fuel system of FIG. 1.

As illustrated in FIG. 2, each fuel injector 32 may embody a mechanically-operated pump-type unit fuel injector. Specifically, each fuel injector may be driven by a cam arrangement 52 to selectively pressurize fuel within fuel injector 32 to a desired pressure level. Cam arrangement 52 may include a cam 54 operably connected to crankshaft 24 such that a rotation of crankshaft 24 results in a corresponding rotation of cam 54. For example, cam arrangement 52 may be connected with crankshaft 24 through a gear train (not shown), through a chain and sprocket arrangement (not shown), or in any other suitable manner. As will be described in greater detail below, during rotation of cam 54, a lobe 56 of cam 54 may periodically drive a pumping action of fuel injector 32 via a pivoting rocker arm 58. It is contemplated that the pumping action of fuel injector 32 may alternatively be driven directly by lobe 56 without the use of rocker arm 58, or that a pushrod (not shown) may be disposed between rocker arm 58 and fuel injector 32.

Fuel injector 32 may include multiple components that interact to pressurize and inject fuel into combustion chamber 22 of engine 10 in response to the driving motion of cam arrangement 52. In particular, each fuel injector 32 may include a injector body 60 having a nozzle portion 62, a plunger 72 disposed within a bore 74 of injector body 60, a plunger spring 75, a valve needle 76, a valve needle spring (not shown), a spill valve 68, a spill valve spring 70, a first electrical actuator 64, a direct operated check (DOC) valve 80, a DOC spring 82, and a second electrical actuator 66. It is contemplated that additional or different components may be included within fuel injector 32 such as, for example, restricted orifices, pressure-balancing passageways, accumulators, and other injector components known in the art.

Injector body 60 may embody a generally cylindrical member configured for assembly within cylinder head 20 and having one or more passageways. Specifically, injector body 60 may include bore 74 configured to receive plunger 72, a bore 84 configured to receive DOC valve 80, a bore 86 configured to receive spill valve 68, and a control chamber 90. Injector body 60 may also include a fuel supply/return line 88 in communication with bores 86, 74, 84, control chamber 90, and nozzle portion 62 via fluid passageways 92, 94, 96, and 98, respectively. Control chamber 90 may be in direct communication with valve needle 76 and selectively supplied with pressurized fuel to affect motion of valve needle 76. It is contemplated that injector body 60 may alternatively embody a multi-member element having one or more housing members, one or more guide members, and any other suitable number and/or type of structural members.

Nozzle portion 62 may likewise embody a cylindrical member having a central bore 100 and a pressure chamber 102. Central bore 100 may be configured to receive valve needle 76. Pressure chamber 102 may hold pressurized fuel supplied from fluid passageway 98 in anticipation of an injection event. Nozzle portion 62 may also include one or more orifices 104 to allow the pressurized fuel to flow from pressure chamber 102 through central bore 100 into combustion chambers 22 of engine 10.

Plunger 72 may be slidingly disposed within bore 74 and movable by rocker arm 58 to pressurize fuel within bore 74. Specifically, as lobe 56 pivots rocker arm 58 about a pivot point 108, an end of rocker arm 58 opposite lobe 56 may urge plunger 72 against the bias of plunger spring 75 into bore 74, thereby displacing and pressurizing the fuel within bore 74. The fuel pressurized by plunger 72 may be selectively directed through fluid passageways 92–98 to spill valve 68, DOC valve 80, control chamber 90, supply/return line 88, and pressure chamber 102 associated with valve needle 76. As lobe 56 rotates away from rocker arm 58, plunger spring 75 may return plunger 72 upward out of bore 74, thereby drawing fuel back into bore 74.

Valve needle 76 may be an elongated cylindrical member that is slidingly disposed within central bore 100 of nozzle portion 62. Valve needle 76 may be axially movable between a first position at which a tip end of valve needle 76 blocks a flow of fuel through orifice 104, and a second position at which orifice 104 is open to allow a flow of fuel into combustion chamber 22. It is contemplated that valve needle 76 may be a multi-member element having a needle member and a piston member, or a single integral element.

Valve needle 76 may have multiple driving hydraulic surfaces. For example, valve needle 76 may include a hydraulic surface 105 located at a base end of valve needle 76 to drive valve needle 76 with the bias of the valve needle spring toward an orifice-blocking position when acted upon by pressurized fuel. Valve needle 76 may also include a hydraulic surface 106 that opposes the bias of the valve needle spring to drive valve needle 76 in the opposite direction toward a second or orifice-opening position when acted upon by pressurized fuel. When both hydraulic surfaces 105 and 106 are exposed to substantially the same fluid pressures, the force exerted by the valve needle spring on valve needle 76 may be sufficient to move valve needle 76 to and hold valve needle 76 in the orifice-blocking position.

Spill valve 68 may be disposed between fluid passageways 92 and 94 and configured to selectively allow fuel displaced from bore 74 to flow through fluid passageway 92 to supply/return line 88 where the pressurized fuel may exit fuel injector 32. Specifically, spill valve 68 may include a valve element 110 connected to first electrical actuator 64. Valve element 110 may have a region of enlarged diameter **110*a*, which is engageable with a valve seat 112 to selectively block the flow of pressurized fuel from fluid passageway 94 to fluid passageway 92. Movement of region 110*a* away from valve seat 112 may allow the pressurized fuel to flow from fluid passageway 94 to fluid passageway 92 and exit fuel injector 32 via supply/return line 88. When fuel forced from bore 74 is allowed to exit fuel injector 32 via supply/return line 88, the buildup of pressure within fuel injector 32 due to inward displacement of plunger 72 may be minimal. However, when the fuel is blocked from supply/return line 88, the displacement of fuel from bore 74 may result in an increase of pressure within fuel injector 32 to about 30,000 psi. Spill valve spring 70 may be situated to bias spill valve 68** toward the flow passing position.

First electrical actuator 64 may include a solenoid 114 and armature 116 for controlling motion of spill valve 68. In particular, solenoid 114 may include windings of a suitable shape through which current may flow to establish a magnetic field such that, when energized, armature 116 may be drawn toward solenoid 114. Armature 116 may be fixedly connected to valve element 110 to move region **110*a* of valve element 110 against the bias of spill valve spring 70 and into engagement with valve seat 112**.

DOC valve 80 may be disposed between fluid passageway 98 and control chamber 90 and configured to selectively communicate fuel displaced from bore 74 with control chamber 90 thereby terminating fuel injection through orifice 104. Specifically, DOC valve 80 may include a valve element 118 connected to second electrical actuator 66. Valve element 118 may have a region of enlarged diameter **118*a*, which is engageable with a valve seat 120 to affect the communication of pressurized fuel with control chamber 90. When the pressurized fuel from fluid passageway 98 is communicated with control chamber 90, the fuel within control chamber 90 may substantially balance the fluid-imposed forces acting on the hydraulic surfaces on valve needle 76 to allow the valve needle spring to move valve needle 76 to move toward the flow-blocking position. DOC spring 82 may be situated to bias DOC valve 80** toward the flow passing position.

Second electrical actuator 66 may include a solenoid 122 and armature 124 for controlling motion of DOC valve 80. In particular, solenoid 122 may include windings of a suitable shape through which current may flow to establish a magnetic field such that, when energized, armature 124 may be drawn toward solenoid 122. Armature 124 may be fixedly connected to valve element 118 to move region **118*a* of valve element 118 against the bias of DOC spring 82 and into engagement with valve seat 120**.

Figures 3A, 3B, 3C, 3D, 3E:
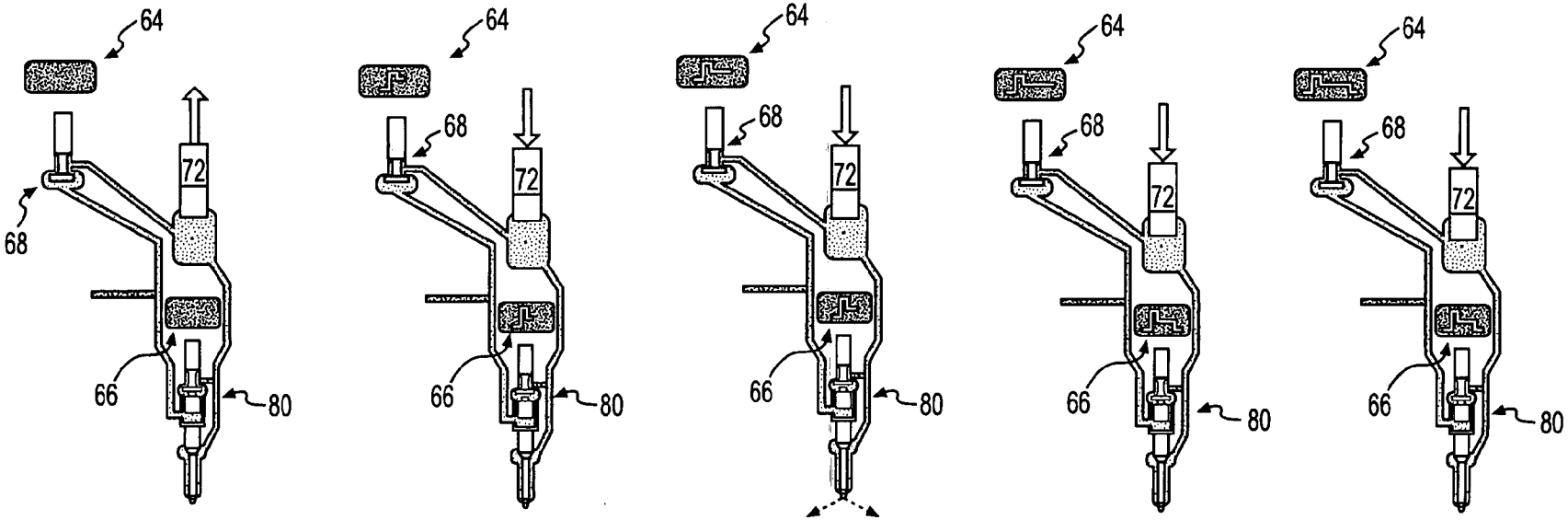
FIGS. 3A–3E are circuit diagrams for the fuel injector of FIG. 2.

In use, starting from the position illustrated in FIG. 3A, fuel injector 32 may fill with fuel when both of first and second electronic actuators 64, 66 are de-energized. In particular, as lobe 56 rotates away from rocker arm 58, plunger spring 75 may urge plunger 72 upward out of bore 74. The outward motion of plunger 72 from bore 74 may act to draw fuel from supply/return line 88 into bore 74 via fluid passageway 92, de-energized spill valve 68, and fluid passageway 94. During the filling operation of fuel injector 32, the forces caused by fluid pressures acting on the hydraulic surfaces of valve needle 76 may be substantially balanced, allowing for the valve needle spring to hold valve needle 76 in the orifice blocking position.

To pressurize the fuel within fuel injector 32, lobe 56 may rotate into engagement with rocker arm 58 to drive plunger 72 into bore 74, thereby displacing fuel from bore 74. If valve element 110 of spill valve 68 remains in the de-energized flow-passing position of FIG. 3A, the fuel displaced by plunger 72 may flow back through fluid passageways 94 and 92 to exit fuel injector 32 via supply/return line 88 without a substantial increase in pressure. However, if valve element 110 of spill valve is moved to the energized flow-blocking position during inward movement of plunger 72, as illustrated in FIG. 3B, the fuel displaced from bore 74 may be blocked from exiting fuel injector 32, thereby causing the pressure within fuel injector 32 to increase in proportion to the displacement of plunger 72. At this point in time, second electrical actuator 66 may also be energized to draw valve element 118 of DOC valve 80 into engagement with valve seat 120 to block pressurizing fluid from control chamber 90.

As the pressure of the fluid within fuel injector 32 continues to increase, the increasing pressure will eventually reach a minimum threshold value or a valve opening pressure (VOP) where the force imparted by the pressure on hydraulic surface 105 exceeds the force of the valve needle spring. As illustrated in FIG. 3C, injection occurs when the force of the valve needle spring is no longer sufficient to retain the valve needle in the orifice-blocking position and valve needle 76 automatically moves against the bias of the valve needle spring to open orifice 104 and initiate injection of pressurized fuel into combustion chamber 22. The time at which valve needle 76 moves away from orifice 104 may correspond to the start of injection timing of fuel injector 32. In this arrangement, the start of injection pressure may be constant for each injection event. As the pressure within fuel injector 32 reaches the VOP value, both of valve elements 110 and 118 are already in the flow-blocking positions.

To end injection, second electrical actuator 66 may be de-energized to allow valve element 118 of DOC valve 80 to return to the flow-passing position under the bias of DOC spring 82, as illustrated in FIG. 3D. As valve element 118 moves to the de-energized flow-passing position, high pressure fuel may be introduced into control chamber 90. The force of the high pressure fuel acting on hydraulic surface 106 combined with the biasing force of the valve needle spring may exceed the force of the high pressure fluid acting on hydraulic surface 105, thereby allowing the valve needle 76 to move to the orifice-blocking position. As valve needle 76 reaches the orifice-blocking position, the injection of fuel into combustion chamber 22 may terminate. The displacement of plunger 72 that occurs after valve needle 76 has moved to the flow-passing position and before valve needle 76 returns to the flow-blocking position may correspond to the amount of fuel injected into combustion chamber 22.

As illustrated in FIG. 3E, almost immediately following the movement of valve element 118 to the flow-passing position, valve element 110 may likewise be moved to the flow-passing position. Valve element 110 may be moved to the flow-passing position to relieve the pressure of the fuel within fuel injector 32 and reduce the load on low pressure source 36.

A time lag may be associated with each of spill valve 68, DOC valve 80, and valve needle 76 between the time that current is applied to or removed from the windings of solenoids 114 and 122, and the time that the respective valve elements actually begin to move or reach their fully closed or open positions. Controller 53 may be configured to determine and apply a delay offset that accounts for this delay when closing or opening spill valve 68 and DOC valve 80.

Figure 4:
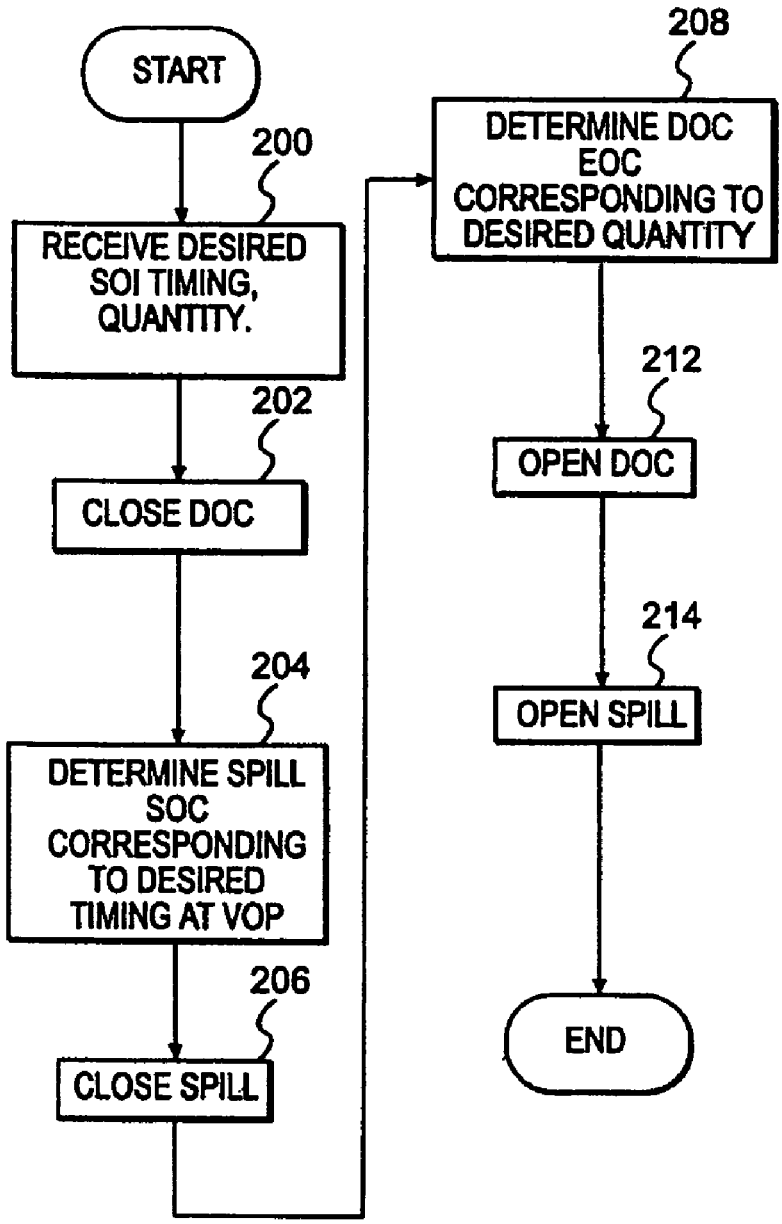
FIG. 4 is a flow chart depicting an exemplary method of operating the fuel injector of FIG. 2.

FIG. 4 illustrates an exemplary method of operating fuel injector 32. FIG. 4 will be discussed in detail below.

INDUSTRIAL APPLICABILITY

The fuel injector and control system of the present disclosure have wide applications in a variety of engine types including, for example, diesel engines, gasoline engines, and gaseous fuel-powered engines. The disclosed fuel injector and control system may be implemented into any engine where consistent accurate injections of small amounts of fuel are important. The operation of control system 35 will now be explained.

As indicated in the flow chart of FIG. 4, a controlled injection event may start by first receiving an indication of a desired start of injection (SOI) timing and a desired injection amount (step 200). For example, engine 10 may request an SOI corresponding to a particular position of piston 18 within combustion chamber 22. Similarly, engine 10 may request a specific quantity of fuel. These requested (e.g., desired) injection characteristics may be received by controller 53 in preparation for injection.

After receiving the desired fuel injection characteristics, controller 53 may energize second electrical actuator 66 to move valve element 118 of DOC valve 80 to the closed position (step 202), and then determine SOC for first electrical actuator 66 that results in the desired SOI timing (step 204). As indicated above, movement of valve element 110 of spill valve 68 toward the energized flow-blocking position may cause an increase in the fuel pressure within fuel injector 32. Once the fuel pressure within 32 reaches the VOP value, injection of fuel into combustion chamber 22 may commence. Controller 53 may calculate the SOC by determining the displacement distance through which plunger 72 must travel to pressurize the fuel within fuel injector 32 to the VOP value before the SOI timing. Controller 53 may then offset the determined SOC to account for system delays associated with movement of valve needle 76. Controller 53 may be programmed with geometric relationships between an angular position of crankshaft 24, a stroke length and area of plunger 72, and/or a displacement position of plunger 72 within bore 74. Because movement of plunger 72 is directly related to an angular position of crankshaft 24, SOI and SOC may be received, determined, and expressed as functions of an angular position of crankshaft 24 and/or a displacement position of plunger 72 within bore 74.

Following the determination of SOC for first electrical actuator 64 associated with spill valve 68, controller 53 may monitor the angular position of crankshaft 24 via sensor 57 and energize first electrical actuator 64 to close spill valve 68 at the calculated angular or related displacement SOC timing (steps 206). After closing spill valve 68, the movement of plunger 72 through the determined displacement may build the pressure of the fuel within fuel injector 32 to the VOP value before the SOI displacement position has been reached by plunger 72. As plunger 72 reaches the determined SOI displacement position (or crankshaft 24 has rotated through the determined crank angle) and the pressure within fuel injector reaches the VOP value, the injection of fuel into combustion chamber 22 may automatically commence.

Controller 53 may determine an EOI timing that corresponds with injection of the desired quantity of fuel. Using the geometric relationships described above, controller 53 may calculate the angle through which crankshaft 24 must turn and/or the displacement through which plunger 72 must move after SOI to push the desired amount of fuel through orifice 104. Controller 53 may then calculate an end of current (EOC) that account for delays associated with DOC valve 80 such that by the end of the injection at the determined EOI timing, the proper amount of fuel has been injected into combustion chamber 22 (step 208).

Controller 53 may end injection by terminating the current supplied to second electrical actuator 66 at the calculated EOC timing (step 212) such that valve element 118 moves to the open position in time for valve needle 76 to block orifice 104 at the EOI timing. In this situation, the EOI pressure is not specifically controlled, but rather dependent upon a displacement velocity of plunger 72 and an area of orifice 104. Immediately following the implementation of EOC for second electrical actuator 66, controller 53 may implement EOC for first electrical actuator 64 to move valve element 110 to the open position and relieve pressure within fuel injector 32 (step 214).

Because controller 53 uses DOC valve 80 only to terminate injection, the operation of fuel injector 32 and engine 10 may be predictable, repeatable, and stable. In particular, because DOC valve 80 is in a stable condition prior to affecting the EOC for second electrical actuator 66, bouncing of valve element 118 and the associated pressure fluctuations within fuel injector 32 may be minimized, while ensuring complete injection events that fulfill the requests of engine 10.

It will be apparent to those skilled in the art that various modifications and variations can be made to the fuel injector and control system of the present disclosure without departing from the scope of the disclosure. Other embodiments will be apparent to those skilled in the art from consideration of the specification and practice of the fuel injector and control system disclosed herein. It is intended that the specification and examples be considered as exemplary only, with a true scope of the disclosure being indicated by the following claims and their equivalents.

What is claimed is:

1. A fuel injector for an internal combustion engine, comprising:

a plunger reciprocatingly disposed within a bore of the fuel injector to displace fuel from the bore;

an electronically controlled spill valve associated with the bore and having a valve element movable between a first position at which the displaced fuel is allowed to drain from the fuel injector, and a second position at which the displaced fuel is retained within the fuel injector and increases in pressure in response to the displacement;

a nozzle member having at least one orifice;

a valve needle having a base end and tip end, being disposed within the nozzle member, and movable against a spring bias to selectively inject the pressurized fuel through the at least one orifice into the internal combustion engine; and an electronically controlled check valve in fluid communication with the bore and the base end of the valve needle, the electronically controlled check valve having a valve element movable between a first position at which the bore is fluidly communicated with the base end of the valve needle, and a second position at which the base end of the valve needle is fluidly communicated with a drain, wherein:

the valve needle is automatically moved to inject the pressurized fuel when the pressure of the fuel within the fuel injector reaches a predetermined valve opening pressure determined by a spring bias;

the valve elements of the electronically controlled spill and check valves are both in the second position before the pressure of the fuel within the fuel injector reaches the predetermined valve opening pressure; and the injection terminates when the valve element of the electronically controlled check valve is moved to the first position.

2. The fuel injector of claim 1, wherein the controller is further configured to determine a time lag between the start of current for the electronically controlled spill and check valves and movement of the valve elements of the electronically controlled spill and check valves and to offset the start of current for the electronically controlled spill and check valves to accommodate the determined time lag.

3. The fuel injector of claim 1, wherein the plunger is cam driven.

4. The fuel injector of claim 1, wherein the internal combustion engine has a crankshaft and the fuel injector further includes a controller in communication with the electronically controlled spill and check valves, the controller configured to:

receive an indication of a desired start of injection timing;

determine a displacement of the plunger based on an angular position of the crankshaft;

determine a start of current for the electronically controlled spill and check valves based on the desired start of injection timing and plunger displacement within the bore; and initiate the start of current determined for the electronically controlled spill and check valves.

5. The fuel injector of claim 4, wherein the start of current determined for the electronically controlled spill valve is initiated substantially simultaneously to the start of current determined for the electronically controlled check valve.

6. The fuel injector of claim 4, wherein the controller is further configured to:

receive an indication of a desired injection quantity;

determine an end of current for the electronically controlled check valve relative to plunger displacement that results in the desired injection quantity; and affect the determined end of current for the electronically controlled check valve.

7. The fuel injection of claim 6, wherein the controller is further configured to affect an end of current for the electronically controlled spill valve substantially immediately following the affecting of the end of current determined for the electronically controlled check valve.

8. A method of operating a fuel injector for an internal combustion engine, the method comprising:

driving a plunger into a bore to displace fuel from the bore;

electronically moving a valve element of a spill valve from a first position at which the displaced fuel is allowed to drain from the fuel injector to a second position at which the displaced fuel is retained within the fuel injector to increase the pressure of the fuel within the fuel injector;

electronically moving a check valve from a first position at which the pressurized fluid is communicated with the base end of the valve needle to a second position at which the base end of the valve needle is fluidly communicated with a drain;

automatically moving a valve needle against a spring bias to selectively inject the pressurized fuel into the internal combustion engine when the fuel pressure within the fuel injector reaches a predetermined valve opening pressure; and terminating the injection by returning the valve element of the electronically controlled check valve to the first position, wherein the valve elements of the electronically controlled spill and check valves are both moved to the second position before the pressure of the fuel within the fuel injector reaches the predetermined valve opening pressure.

9. The method of claim 8, further including:

determining a time lag between the start of current for the spill and check valves and movement of the valve elements of the spill and check valves; and offsetting the start of current for the spill and check valves to accommodate the determined time lag.

10. The method of claim 8, wherein driving includes cammingly driving.

11. The method of claim 8, wherein the internal combustion engine has a crankshaft and the method further includes:

receiving an indication of a desired start of injection timing;

determining a displacement of the plunger based on an angular position of the crankshaft;

determining a start of current for the spill and check valves based on the desired start of injection and plunger displacement within the bore; and initiating the start of current determined for the spill and check valves.

12. The method of claim 11, wherein initiating the start of current includes initiating the start of displacement for the spill and check valves substantially simultaneously.

13. The method of claim 11, further including:

receiving an indication of a desired injection quantity;

determining an end of current for the check valve relative to plunger displacement that results in the desired injection quantity; and affecting the determined end of current for the check valve.

14. An internal combustion engine, comprising:

an engine block having at least one combustion chamber;

a crankshaft rotatingly disposed within the engine block; and a fuel system including:

a fuel injector configured to inject a desired quantity of pressurized fuel into the combustion chamber at a desired timing, the fuel injector including:

a plunger reciprocatingly disposed within a bore of the fuel injector to displace fuel from the bore;

an electronically controlled spill valve associated with the bore and having a valve element movable between a first position at which the displaced fuel is allowed to drain from the fuel injector, and a second position at which the displaced fuel is retained within the fuel injector and increases in pressure in response to the displacement;

a nozzle member having at least one orifice;

a valve needle having a base end and tip end, being disposed within the nozzle member, and movable against a spring bias to selectively inject the pressurized fuel through the at least one orifice into the combustion chamber;

an electronically controlled check valve in fluid communication with the bore and the base end of the valve needle, the electronically controlled check valve having a valve element movable between a first position at which the bore is fluidly communicated with the base end of the valve needle, and a second position at which the base end of the valve needle is fluidly communicated with a drain;

wherein:

the valve needle is automatically moved to inject the pressurized fuel when the pressure of the fuel within the fuel injector reaches a predetermined valve opening pressure determined by a spring bias;

the valve elements of the electronically controlled spill and check valves are both in the second position before the pressure of the fuel within the fuel injector reaches the predetermined valve opening pressure; and the injection terminates when the valve element of the electronically controlled check valve is moved to the first position.

15. The internal combustion engine of claim 14, further including a controller in communication with the electronically controlled spill and check valves, the controller configured to:

receive an indication of a desired start of injection timing;

determine a displacement of the plunger based on an angular position of the crankshaft;

determine a start of current for the electronically controlled spill and check valves based on the desired start of injection timing and plunger displacement within the bore; and initiate the start of current determined for the electronically controlled spill and check valves.

16. The internal combustion engine of claim 15, wherein the start of current determined for the electronically controlled spill valve is initiated substantially simultaneously to the start of current determined for the electronically controlled check valve.

17. The internal combustion engine of claim 15, wherein the controller is further configured to determine a time lag between the start of current for the electronically controlled spill and check valves and movement of the valve elements of the electronically controlled spill and check valves and to offset the start of current for the electronically controlled spill and check valves to accommodate the determined time lag.

18. The internal combustion engine of claim 15, wherein the plunger is cam driven.

19. The internal combustion engine of claim 15, wherein the controller is further configured to:

receive and indication of a desired injection quantity;

determine an end of current for the electronically controlled check valve relative to plunger displacement that results in the desired injection quantity; and affect the determined end of current for the electronically controlled check valve.

20. The internal combustion engine of claim 19, wherein the controller is further configured to affect an end of current for the electronically controlled spill valve substantially immediately following the affecting of the end of current determined for the electronically controlled check valve.

* * * * *